US005713677A

United States Patent [19]

Petoskey

[11] Patent Number: 5,713,677

[45] Date of Patent: Feb. 3, 1998

[54] INK RIBBON CARTRIDGE HAVING TRANSFER ROLLER WITH STAGGERED UPPER AND LOWER TEETH ARRANGEMENT

[75] Inventor: Dennis G. Petoskey, Dacula, Ga.

[73] Assignee: Dataproducts Corporation, Simi Valley, Calif.

[21] Appl. No.: 674,647

[22] Filed: Jun. 25, 1996

[51] Int. Cl.[6] ..... B41J 27/12; B41J 31/16

[52] U.S. Cl. ..... 400/197; 400/200

[58] Field of Search ..... 400/197, 200, 400/201

[56] References Cited

U.S. PATENT DOCUMENTS

| | | | |
|---|---|---|---|
| 4,636,097 | 1/1987 | Goubeaux | 400/197 |
| 4,968,161 | 11/1990 | Kunitomi et al. | 400/197 |
| 5,190,385 | 3/1993 | Taguchi et al. | 400/197 |

*Primary Examiner*—Edgar S. Burr
*Assistant Examiner*—Amanda B. Sandusky
*Attorney, Agent, or Firm*—Loeb & Loeb LLP

[57] ABSTRACT

In an ink ribbon cartridge (or cartridge ribbon) in which a length of ink ribbon driven through the cartridge is re-inked by a rotatable foam cylinder or reinker saturated with ink, an improved transfer roller is provided for transferring ink from the reinker onto the surface of the ink ribbon as the ink ribbon is advanced past the transfer roller. The transfer roller is of generally cylindrical shape and is provided with a plurality of elongated raised ridges or teeth on the outer surface thereof. The teeth present a surface area which transfers a desired amount of ink from the reinker to the ink ribbon as the ink ribbon rotates the transfer roller, and thereby the reinker. At the same time, positive engagement of the transfer roller with the ink ribbon and the reinker is enhanced, for the given surface area presented by the teeth, by offsetting or staggering a lower arrangement of the teeth relative to an upper arrangement thereof on the outer surface of the transfer roller. The elongated teeth extend along substantially the entire length of either an upper or a lower portion of the transfer roller, are generally equally spaced around the outer circumference or periphery of the transfer roller and are generally parallel with the central axis of the transfer roller. The offset or staggered configuration of the teeth locates each of the teeth of the upper arrangement approximately equidistantly between a pair of teeth of the lower arrangement.

7 Claims, 2 Drawing Sheets

INK RIBBON CARTRIDGE HAVING TRANSFER ROLLER WITH STAGGERED UPPER AND LOWER TEETH ARRANGEMENT

BACKGROUND OF THE INVENTION

1. Field of the Invention

The present invention relates to ink ribbon cartridges, and more particularly to ink ribbon cartridges in which a transfer roller is used to transfer ink from a foam cylinder to a length of ink ribbon.

2. History of the Prior Art

It is known to provide ink ribbon cartridges (or "cartridge ribbons" as they are commonly known in the industry) for use in conjunction with various types of impact printers. An example of an impact printer which uses an ink ribbon cartridge is a printer specially designed to print small items such as lottery tickets at the point of sale of such tickets. Lottery ticket printers comprise a form of dot matrix printer in which the ink ribbon cartridge is mounted within the printer adjacent a print head. The print head undergoes reciprocating motion relative to a portion of the ink ribbon extending across the front of the ink ribbon cartridge, to effect impact printing of the paper.

As impact printing is carried out by the printer, the length of ink ribbon within the cartridge is periodically advanced in a given direction. Ribbon advancement is typically accomplished using a drive motor external to the cartridge and having a drive spindle engaging a shaft of a drive gear assembly within the cartridge. The drive gear assembly and an opposing idler gear assembly, mounted within the cartridge case, resiliently engage the length of ink ribbon therebetween so as to selectively advance the length of ink ribbon through the cartridge and across the front thereof to provide for impact printing by the print head.

The periodic advancement of the length of ink ribbon through the cartridge is necessary in order to continuously replenish the supply of ink in the ribbon as it is used up during the printing operation. Typically, the length of ribbon is inked by an arrangement which includes a rotatable foam cylinder (or "reinker" as it is commonly known in the industry). The foam reinker is saturated with ink. As the length of ink ribbon is advanced through the cartridge by the drive gear assembly and the opposing idler gear assembly, the ink ribbon rotates a transfer roller which is rotatably positioned adjacent the path of the ink ribbon so as to engage the ribbon. This rotates the transfer roller. Because the transfer roller also engages the reinker, this rotates the reinker as well. As the reinker is rotated, ink stored therein is transferred onto the surface of the transfer roller. As the transfer roller is rotated, the ink on the surface thereof is transferred onto the ink ribbon. In this manner, the ink ribbon is continuously provided with a fresh supply of ink.

The design and operation of the transfer roller are critical to the successful re-inking of the ink ribbon. The transfer roller must securely engage both the ink ribbon and the reinker, so that the transfer roller and the reinker are rotated by the passing ink ribbon. Lack of proper engagement of the transfer roller with either the ink ribbon or the reinker can result in slipping and stalling, and eventual malfunction of the ribbon cartridge. In addition to proper engagement and driving of the transfer roller and the reinker, the transfer roller must transfer the correct amount of ink from the reinker to the ink ribbon. Too little ink can result in light printing. On the other hand, too much ink can lead to heavy printing, blotchiness and even jamming of the cartridge. In an effort to ensure positive engagement of the transfer roller with both the ink ribbon and the reinker, most conventional transfer rollers present a relatively large amount of the surface area thereof to the ink ribbon and the reinker, using teeth or other projections from the surface, with the resulting tendency to transfer too much ink to the ink ribbon. Efforts to reduce such surface area in an effort to reduce the amount of transferred ink often result in less than positive engagement of the transfer roller, with resulting slippage and occasional stalling or jamming of the cartridge.

It would therefore be desirable to provide an improved ink ribbon cartridge transfer roller. Such roller should be capable of transferring desired amounts of ink from the reinker to the ink ribbon while at the same time providing positive engagement of the transfer roller with the ink ribbon and the reinker so as to prevent slipping and stalling.

BRIEF SUMMARY OF THE INVENTION

Briefly stated, the present invention provides an improved transfer roller for use with ink ribbon cartridges. The improved transfer roller is capable of transferring desired mounts of ink from an engaging foam cylinder or reinker to a passing length of ink ribbon, also engaged by the transfer roller, while at the same time maintaining positive engagement of the transfer roller with the length of ink ribbon and the reinker so as to prevent slippage or stalling.

Improved transfer rollers in accordance with the invention are generally cylindrical in shape and are provided at an outer surface thereof with an arrangement of elongated ridges or teeth. The teeth have a surface area which transfers the desired amount of ink from the reinker to the ink ribbon. At the same time, the teeth engage both the reinker and the ink ribbon in a positive manner which prevents slipping or stalling relative thereto.

In accordance with a feature of the invention the elongated teeth at the outer surface of the transfer roller are arranged into upper and lower arrangements thereof which are offset relative to each other. This "staggering" of the teeth at the outer surface of the transfer roller has the effect of presenting a half tooth twice as often, to the ink ribbon and the reinker, as compared with the case of each tooth extending continuously along the entire length of the transfer roller. As a result, the offset or staggered arrangement of the teeth provides for improved engagement of the transfer roller with the ink ribbon and the reinker. This allows the teeth to be made smaller and to be spaced further apart from each other, so that a correct amount of ink is transferred while at the same time maintaining positive engagement of the transfer roller with the ink ribbon and the reinker.

In a preferred embodiment of the improved transfer roller, the upper and lower arrangements of teeth on the outer surface of the cylindrical roller and approximately equal in length along the central axis of rotation of the roller. The teeth of the lower arrangement extend along the entire length of the lower portion and are generally equally spaced from each other around the outer surface of the roller and are generally parallel to the central axis. Likewise, the teeth of the upper arrangement extend along the entire length of the upper portion of the roller, are generally equidistantly spaced from each other, and are generally parallel to the central axis. At the same time, the teeth of the upper and lower arrangements are offset or staggered, such that each tooth of the upper arrangement is disposed approximately equidistantly between a pair of the teeth in the lower arrangement.

BRIEF DESCRIPTION OF THE DRAWINGS

A detailed description of the invention will be made with reference to the accompanying drawings, in which.

DETAILED DESCRIPTION

Figure 1:
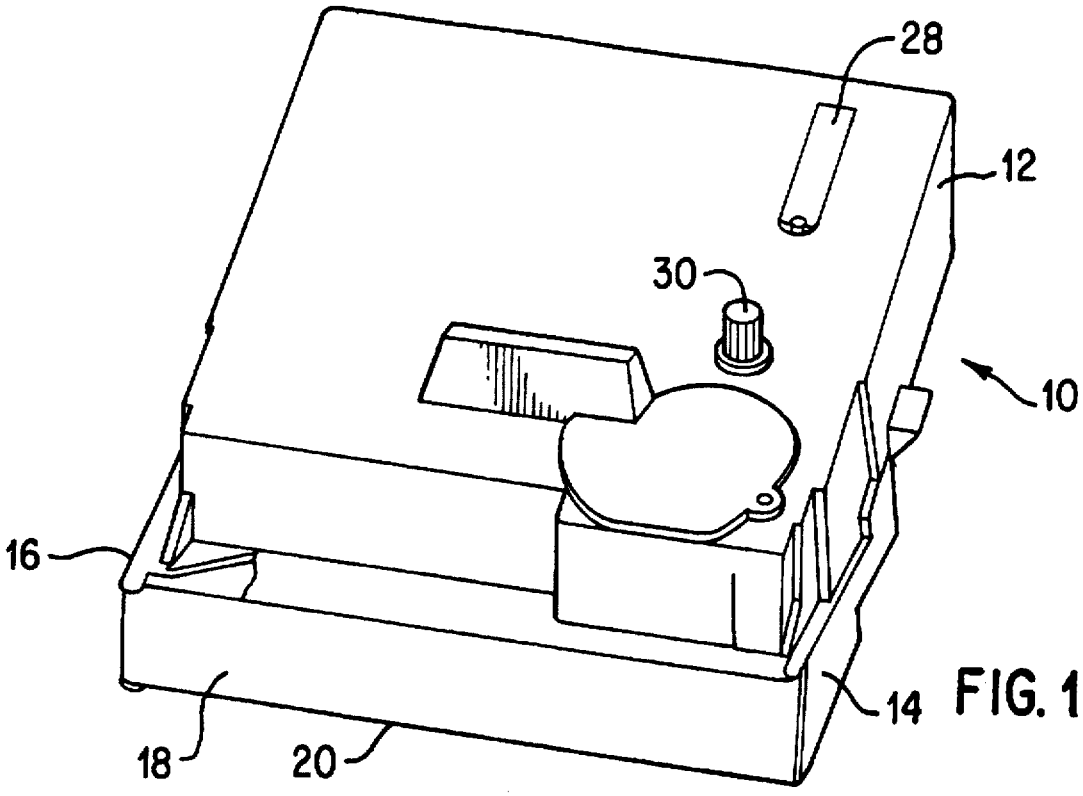
FIG. 1 is a perspective view of an ink ribbon cartridge having an improved transfer roller in accordance with the invention.
Figure 2:
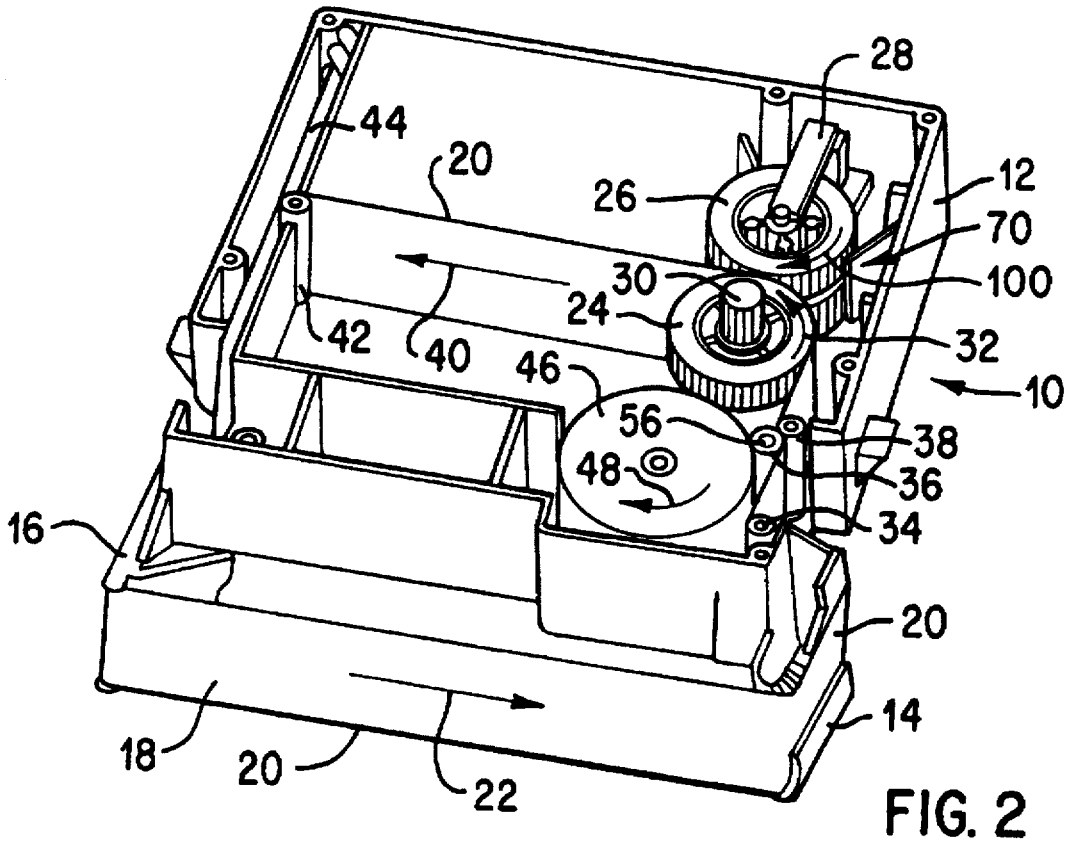
FIG. 2 is a perspective view of the cartridge of FIG. 1 with the top of the cartridge case removed in order to show the interior details thereof.

FIGS. 1 and 2 show an ink ribbon cartridge or cartridge ribbon 10 having an improved transfer roller in accordance with the invention. The ink ribbon cartridge 10 includes a case 12 of relatively thin, generally planar configuration. The case 12 has an opposite pair of projecting portions 14 and 16 at the front thereof for presenting a portion 18 of a continuous length of ink ribbon 20 for use by an adjacent print head (not shown) for impact printing. The ink ribbon 20 is periodically advanced, in a direction shown by an arrow 22 at the portion 18 thereof, by a drive mechanism located at the interior of the case 12. The drive mechanism includes a drive gear assembly 24 and an opposing idler gear assembly 26 disposed opposite the drive gear assembly 24. The idler gear assembly 26 is biased toward the drive gear assembly 24 by a spring loaded mechanism 28 on which it is mounted. The drive gear assembly 24 is rotatably mounted on a shaft 30 having a lower end which protrudes slightly from an underside of the cartridge case 12. Engagement of the lower end of the shaft 30 by a drive spindle of a motor (not shown) external to the cartridge 10 periodically rotates the drive gear assembly 24 in a direction shown by an arrow 32, to advance the ink ribbon 20 through the cartridge 10.

The portion 18 of the ink ribbon 20 extends across the front of the cartridge 10, between the projecting portions 14 and 16, as previously noted. At the rear of the projecting portion 14, the ribbon 20 undergoes two different 90° bends, so as to elevate the plane of motion of the ribbon, before it enters the case 12 and wraps around an idler roller 34. From the idler roller 34, the ribbon 20 extends partly around a rotatably mounted transfer roller 36, where the ribbon 20 is held in engagement with the transfer roller 36 by an adjacent idler roller 38. From the idler roller 38, the ribbon 20 extends around the drive gear assembly 24 and against the opposing idler gear assembly 26. Periodic driving of the drive gear assembly 24 advances the ink ribbon 20 through the cartridge 10, as previously described. From the drive gear assembly 24, the ink ribbon 20 moves across the interior of the cartridge case 12, in a direction shown by an arrow 40, to an idler roller 42. From the idler roller 42, the ink ribbon 20 extends forwardly to the rear of the projecting portion 16, where the ink ribbon 20 undergoes two 90° bends before wrapping around the projecting portion 16 and extending across the front of the cartridge 10. A drag spring 44 at the rear left of the cartridge case 12 resiliently bears against the ink ribbon 20, at the idler roller 42, to retard the motion of the ink ribbon 20, making the ribbon motion more consistent.

As the ink ribbon 20 is moved through the ribbon path, defined by the various gear assemblies and idler rollers within the case 12, the supply of ink in the ribbon 20 is replenished by an arrangement which includes the transfer roller 36 and a rotatable foam cylinder or reinker 46. As the ribbon 20 is advanced around the transfer roller 36, the idler roller 38 forces the ribbon 20 against the transfer roller 36 to enhance the engagement of the ribbon 20 with the transfer roller 36 and thereby ensure that the transfer roller 36 rotates with movement of the ribbon 20. At the same time, the transfer roller 36 engages an outer surface of the reinker 46, causing the reinker 46 to rotate as the transfer roller 36 rotates. The reinker 46 rotates in a direction shown by an arrow 48. As the transfer roller 36 and the reinker 46 rotate, the reinker 46 transfers ink onto the outer surface of the transfer roller 36, and the transfer roller 36 in turn transfers the ink onto the ink ribbon 20.

Figure 3:
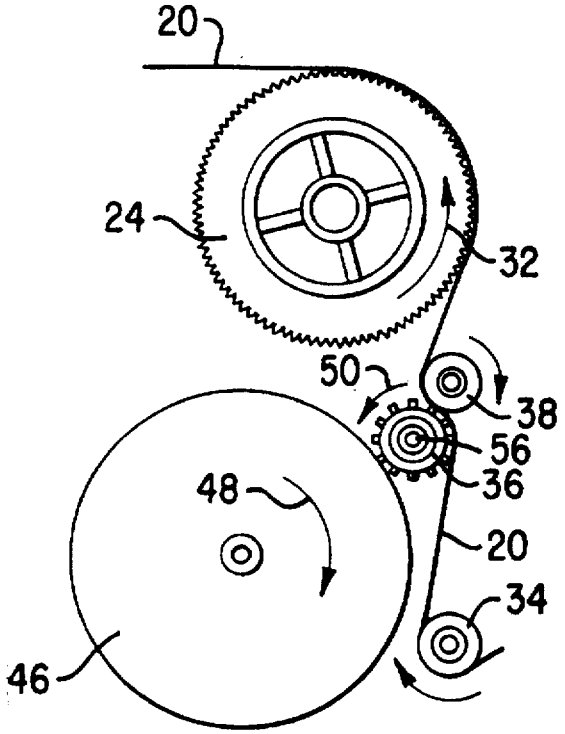
FIG. 3 is a top view of a portion of the cartridge of FIGS. 1 and 2, showing the interrelationship of the transfer roller with the ink ribbon and the reinker.
Figure 4:
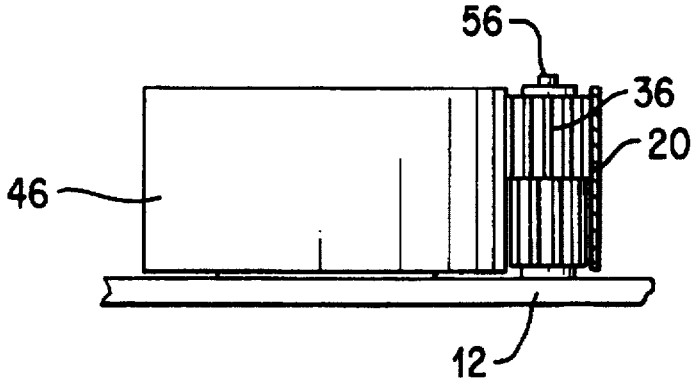
FIG. 4 is a front elevational view of a portion of the cartridge of FIGS. 1 and 2, showing the manner in which the transfer roller simultaneously engages the ink ribbon and the reinker.

The details of the path of movement of the ribbon 20 and the transfer of ink from the reinker 46 to the ribbon 20, are better shown by the views of FIGS. 3 and 4. After wrapping around the idler roller 34, the ribbon 20 advances to the interface between the transfer roller 36 and the idler roller 38. As previously noted, the idler roller 38 enhances engagement of the ribbon 20 by the transfer roller 36. From the interface of the transfer roller 36 and the idler roller 38, the ribbon 20 extends to and wraps around the drive gear assembly 24. As the drive gear assembly 24 periodically advances the ribbon 20, the ribbon 20 is pulled through the interface of the transfer roller 36 with the idler roller 38, and this rotates the transfer roller 36 in a direction shown by an arrow 50 in FIG. 3. At the same time, and because the transfer roller 36 engages the reinker 46, rotation of the transfer roller 36 rotates the reinker 46 in the direction shown by the arrow 48.

As will be appreciated, the transfer roller 36 is an important component in driving the reinker 46 in response to motion of the ribbon 20 so that ink is continuously supplied from the reinker 46, via the transfer roller 36, to the ribbon 20, as the ribbon 20 is advanced through the cartridge 20. The transfer roller 36 is designed to maintain positive engagement with the ribbon 20 and the reinker 46, while at the same time transferring a desired amount of ink from the reinker 46 to the ribbon 20. The positive engagement of the transfer roller 36 with the ribbon 20 and the reinker 46 is necessary in order to prevent slippage or eventual stalling which can jam the cartridge 10. At the same time, the portion of the surface of the transfer roller 36 coming into contact with the reinker 46 must transfer a desired amount of ink to the ribbon 20. Too little ink being transferred can result in light printing, while too much ink can result in heavy print, blotchiness and even eventual jamming of the cartridge 10.

Figure 5:
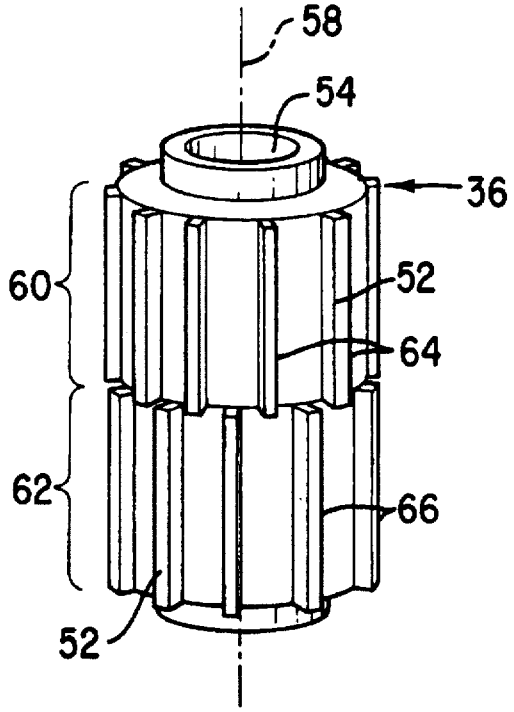
FIG. 5 is an enlarged perspective view of the transfer roller.

The transfer roller 36, which is shown in detail in FIG. 5, has been found to provide a successful compromise, inasmuch as it transfers the desired amount of ink while at the same time maintaining positive, non-slip engagement with the ribbon 20 and the reinker 46. As shown in FIG. 5, the transfer roller 36 is provided with a plurality of elongated ridge-like teeth 52 at an outer surface thereof. The transfer roller 36 is of generally cylindrical configuration, and is provided with a central bore 54 extending therethrough. The central bore 54 receives an upstanding pin 56, shown in FIGS. 2, 3 and 4 to rotatably mount the transfer roller 36 within the case 12 of the cartridge 10. The bore 54 extends along a central axis 58 of the transfer roller 36.

The transfer roller 36 is comprised of upper and lower portions 60 and 62 of approximately equal length. The upper portion 60 includes a first arrangement 64 of the elongated teeth 52. Each of the teeth 52 of the upper arrangement 64 extends along the entire length of the upper portion 60 of the transfer roller 36, and is generally parallel with the central axis 58. In addition, the teeth 52 of the upper arrangement 64 are generally equally spaced around the outer periphery or circumference of the upper portion 60. In similar fashion, the lower portion 62 of the transfer roller 36 is provided with a second arrangement 66 of the elongated teeth 52, such that each such tooth 52 extends along the entire length of the lower portion 62 and is generally parallel with the central axis 58. As in the case of the upper tooth arrangement 64, the teeth 52 of the lower arrangement 66 are generally equally spaced around the outer periphery of the lower portion 62. The arrangements 64 and 66 contain like numbers of the teeth 52, and the spacing between adjacent pairs of teeth in each of the arrangements 64 and 66 is similar. Also, the upper and lower portions 60 and 62 are equal in length, in the direction of the central axis 58, so that the teeth 52 in the arrangements 64 and 66 have like lengths. As shown in FIG. 5, the teeth 52 of the lower arrangement 66 are offset or "staggered" relative to the teeth 52 of the upper arrangement 64. More specifically, and in the example of FIG. 5, each tooth 52 of the upper arrangement 64 is positioned so as to be equidistantly spaced between a pair of the teeth 52 of the lower arrangement 66. The resulting offset or staggered pattern of the teeth 52 has the effect of presenting a half tooth twice as often, as would be the case if the teeth 52 extended continuously along the entire length of the transfer roller 36. As a result, improved engagement is achieved between the transfer roller 36 and the ribbon 20 and the reinker 46, even though the total area of the outer surfaces of the teeth 52 is considerably less than in the case of prior art transfer rollers where the contact area must be increased to provide for positive engagement. The reduced surface area presented by the teeth 52 of the arrangement of FIG. 5 provides for the transfer of a desired amount of ink from the reinker 46 to the ribbon 20. The increased surface area needed for positive engagement of the transfer roller 36, in prior art arrangements, tends to transfer too much ink to the ribbon 20.

The transfer roller 36 may be made of any appropriate material such as plastic. In the present example, the transfer roller 36 is molded of plastic, so that the teeth 52 are integrally formed with the cylinder comprising the main portion of the transfer roller 36. The offset or staggered configuration of the teeth 52 can be achieved by forming the upper and lower portions 60 and 62 of virtually identical configuration, and then joining them together so that the teeth 52 thereof are offset in the desired manner.

While the invention has been particularly shown and described with reference to a preferred embodiment thereof, it will be understood by those skilled in the art that various changes in form and details may be made therein without departing from the spirit and scope of the invention.

What is claimed is:

1. An ink ribbon cartridge comprising the combination of:

a cartridge case;

means defining a ribbon path through the cartridge case;

a length of ink ribbon disposed along the ribbon path within the cartridge case:

a rotatable cylindrical element for storing a quantity of ink, mounted within the cartridge case; and a transfer roller rotatably mounted within the cartridge case to engage the length of ink ribbon and the rotatable cylindrical element, said transfer roller being rotated solely in response to movement of the length of ink ribbon which in turn rotates the rotatable cylindrical element so that ink on the rotatable cylindrical element is transferred to the length of ink ribbon by the transfer roller, the transfer roller having a plurality of elongated teeth extending outwardly from an outer surface thereof and spaced apart from each other around the circumference of the outer surface, the plurality of elongated teeth being arranged into upper and lower arrangements in which the teeth of the upper arrangement are staggered relative to the teeth in the lower arrangement around the circumference of the outer surface of the transfer roller.

2. The invention set forth in claim 1, wherein the transfer roller is in the shape of a cylinder having a central axis of rotation, the lower arrangement includes a plurality of spaced-apart teeth extending along a length thereof in the direction of the central axis and the upper arrangement includes a plurality of spaced-apart teeth extending along a length thereof in the direction of the central axis and each being positioned between a pair of the teeth of the lower arrangement.

3. The invention set forth in claim 2, wherein the upper and lower arrangements have like numbers of teeth.

4. In an ink ribbon cartridge, an arrangement for inking a length of ribbon movable along a ribbon path within the cartridge comprising:

a generally cylindrical transfer roller rotatably mounted within the cartridge and in contact with the length of ribbon, the transfer roller having a first plurality of outwardly extending teeth on an upper portion thereof and a second plurality of outwardly extending teeth on a lower portion thereof, the teeth of the lower portion being staggered relative to the teeth of the upper portion around a circumference of the transfer roller; and a cylindrical foam element rotatably mounted within the cartridge, the foam element being capable of storing a quantity of ink therein and having an outer surface thereof in contact with the transfer roller;

said transfer roller being rotated solely in response to movement of the length of ribbon which in turn rotates the foam element so that ink on the foam element is transferred to the length of ribbon by the first and second pluralities of teeth of the transfer roller.

5. A transfer roller for use with an ink ribbon cartridge comprising:

a body having a cylindrical outer surface and a central axis of rotation and being divided into opposite upper and lower portions;

a first plurality of elongated, ridge-like teeth extending outwardly from the cylindrical outer surface along the upper portion of the body and being generally equally spaced around a circumference of the body and each being generally parallel to the central axis; and a second plurality of elongated, ridge-like teeth extending outwardly from the cylindrical outer surface along the lower portion of the body and being generally equally spaced around the circumference of the body and each being generally parallel to the central axis;

the first and second pluralities of elongated teeth being staggered relative to each other around the circumference of the body such that each of the first plurality of elongated, ridge-like teeth is disposed approximately equidistantly between a pair of teeth of the second plurality of elongated, ridge-like teeth.

6. The invention set forth in claim 5, wherein the body is made of plastic and the first and second pluralities of elongated, ridge-like teeth are made of plastic and are integrally formed with the body.

7. The invention set forth in claim 5, wherein the upper and lower portions of the body are approximately equal in length along the central axis, the teeth of the first plurality extend along the entire length of the upper portion and the teeth of the second plurality extend along the entire length of the lower portion.

* * * * *